US008181331B2

(12) United States Patent
Brandstätter et al.

(10) Patent No.: US 8,181,331 B2
(45) Date of Patent: May 22, 2012

(54) METHOD FOR PRODUCING HARDENED PARTS FROM SHEET STEEL

(75) Inventors: Werner Brandstätter, Linz (AT); Josef Faderl, Steyr (AT); Martin Fleischanderl, Rainbach i.M. (AT); Siegfried Kolnberger, Pasching (AT); Gerald Landl, Linz (AT); Anna Elisabeth Raab, Linz (AT); Robert Vehof, Amersfoort (NL); Wolfgang Stall, Heubach (DE)

(73) Assignees: voestalpine Automotive GmbH, Linz (AT); voestalpine Stahl GmbH, Linz (AT)

( * ) Notice: Subject to any disclaimer, the term of this patent is extended or adjusted under 35 U.S.C. 154(b) by 1352 days.

(21) Appl. No.: 10/566,219

(22) PCT Filed: Jun. 9, 2004

(86) PCT No.: PCT/EP2004/006252

§ 371 (c)(1), (2), (4) Date: Sep. 14, 2006

(87) PCT Pub. No.: WO2005/021821

PCT Pub. Date: Mar. 10, 2005

(65) Prior Publication Data

US 2007/0000117 A1 Jan. 4, 2007

(30) Foreign Application Priority Data

Jul. 29, 2003 (AT) ..... A 1202/2003
Jul. 29, 2003 (AT) ..... A 1203/2003

(51) Int. Cl.

| | |
|---|---|
| ***B21B 1/46*** | (2006.01) |
| ***B21B 13/22*** | (2006.01) |
| ***B22D 11/126*** | (2006.01) |
| ***B22D 11/128*** | (2006.01) |
| ***B23P 17/00*** | (2006.01) |
| ***B23P 25/00*** | (2006.01) |

(52) U.S. Cl. ..... 29/527.2; 29/557; 72/47; 148/643

(58) Field of Classification Search ..... 29/505, 29/527.2, 514, 557; 72/47, 168, 177, 432.1, 72/342.5; 148/640, 643; 205/220, 232, 244, 205/305; 427/383.1, 433, 436; 428/659, 428/939

See application file for complete search history.

(56) References Cited

U.S. PATENT DOCUMENTS 5,916,389 A * 6/1999 Lundstrom ..... 148/643

(Continued)

FOREIGN PATENT DOCUMENTS

DE 2 003 306 7/1970

(Continued)

OTHER PUBLICATIONS

ASM Handbook: Surface Engineering, ASM International, XP-002298196, 1995, pp. 339-340; 713-714.

*Primary Examiner* — Donghai D. Nguyen
(74) *Attorney, Agent, or Firm* — Setter Roche LLP

(57) ABSTRACT

The invention relates to a method for producing hardened structural parts from sheet steel. The method includes shaping at least one shaped part made of sheet steel provided with a cathodic corrosion protection coating, performing any required final trim of the shaped part and possibly any required punching, or the creation of a perforation pattern, subsequently heating the shaped part, at least over partial areas, under the admission of atmospheric oxygen to a temperature which permits austenizing of the steel material, and thereafter transferring the structural part to a mold-hardening tool and performing mold-hardening in the mold-hardening tool, wherein the structural part is cooled by the contact with and pressing by the mold-hardening tool and is hardened thereby.

17 Claims, 1 Drawing Sheet

U.S. PATENT DOCUMENTS

| | | | | |
|---|---|---|---|---|
| 6,558,815 | B1 * | 5/2003 | Suzuki et al. | 427/433 |
| 6,564,604 | B2 | 5/2003 | Kefferstein et al. | |

FOREIGN PATENT DOCUMENTS

| | | | |
|---|---|---|---|
| DE | 197 23 655 | A1 | 12/1997 |
| DE | 100 49 660 | A1 | 4/2002 |
| DE | 101 20 063 | C2 | 11/2002 |
| DE | 102 46 614 | A1 | 4/2004 |
| DE | 102 54 695 | B3 | 4/2004 |
| EP | 1 013 785 | A1 | 6/2000 |
| EP | 1 253 208 | A1 | 10/2002 |
| EP | 1 439 240 | A1 | 7/2004 |
| FR | 2 534 161 | | 4/1984 |
| GB | 1 490 535 | | 11/1977 |
| JP | 4 002758 | | 1/1992 |
| JP | 6 256925 | | 9/1994 |
| WO | 03/035922 | | 5/2003 |

* cited by examiner

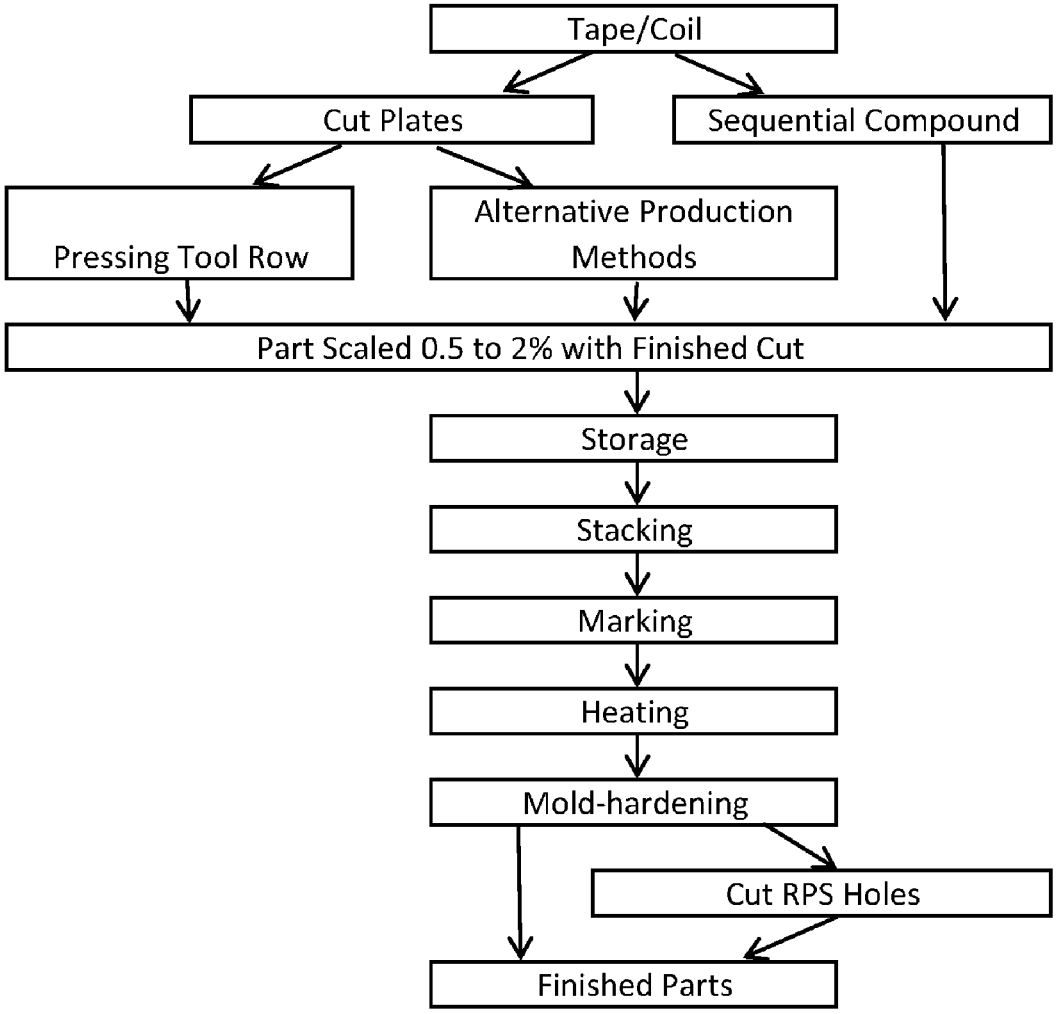
Tape/Coil
Cut Plates
Sequential Compound
Pressing Tool Row
Alternative Production Methods
Part Scaled 0.5 to 2% with Finished Cut
Storage
Stacking
Marking
Heating
Mold-hardening
Cut RPS Holes
Finished Parts

METHOD FOR PRODUCING HARDENED PARTS FROM SHEET STEEL

FIELD OF THE INVENTION

The invention relates to a method for producing hardened structural parts from sheet steel, as well as to hardened structural parts made of sheet steel which have been produced by means of this method.

BACKGROUND OF THE INVENTION

In the field of automobile construction there is a desire for lowering the total weight of the vehicles or, in case of improved accessories, not to let the total vehicle weight increase. This can only be realized if the weight of particular vehicle parts is lowered. In this connection in particular it is attempted to definitely lower the weight of the vehicle body in comparison with previous times. However, at the same time the demands made on safety, in particular the safety of people inside the motor vehicle, and on the conditions in case of accidents, have risen. While the number of parts for lowering the body gross weight is reduced, and their thickness in particular is reduced, it is expected that the body shell of reduced weight displays increased sturdiness and stiffness along with a definite deformation behavior in case of an accident.

Steel is the raw material most used in producing auto bodies. Structural parts with the most diverse material properties cannot be made available cost-effectively in such large ranges by any other material.

The result of these changed demands is that, along with great sturdiness, large expansion values, and therefore an improved cold-forming capability, are assured. Moreover, the range of sturdiness which can be shown for steel has been increased.

One perspective, in particular for bodies in connection with automobile construction, relates to structural parts made out of thin sheet steel of a sturdiness, which is a function of the alloy composition, in a range between 1000 to 2000 MPa. For achieving a sturdiness of this type in the structural part, it is known to cut appropriate plates out of sheets, to heat the plates to a temperature above the austenizing temperature and thereafter to shape the structural part in a press, wherein rapid cooling of the material is simultaneously provided during the shaping process.

A scale layer is formed on the surface during the annealing process for austenizing the plates. This is removed after shaping and cooling. Customarily this is performed by means of a sandblasting method. Prior to or after this scale removal, the final trimming and the punching of holes are performed. It is disadvantageous if the final trimming and the punching of the holes are performed prior to sandblasting, since the cut edges and edges of the holes are detrimentally affected. Regardless of the sequence of the processing steps following hardening, it is disadvantageous in connection with scale removal by means of sandblasting that the structural part is often warped by this. A so-called piece coating with a corrosion layer takes place after the mentioned processing steps. For example, a cathodically effective corrosion-protection layer is applied.

In this connection it is disadvantageous that finishing of the hardened structural part is very elaborate and, because of the hardening of the structural part, is subject to great wear. Moreover, it is a disadvantage that the piece coating customarily provides a corrosion protection which is not particularly strongly developed. The layer thicknesses are furthermore not uniform and instead vary over the structural part surface.

In a modification of this method it is also known to cold-form a structural part from a sheet metal plate and to subsequently heat it to the austenizing temperature and then to cool it rapidly in a calibrating tool, wherein the calibrating tool is responsible for calibrating the shaped areas which had been warped by heating. Subsequently the previously described finishing takes place. In comparison with the previously described methods, this method makes possible more complex geometric shapes, since it is possible in the course of simultaneous shaping and hardening to only create substantially linear shapes, but complex shapes cannot be realized in the course of such shaping processes.

A method for producing a hardened structural steel part is known from GB 1 490 535, wherein a sheet of hardenable steel is heated to the hardening temperature and is subsequently arranged in a shaping device, in which the sheet is brought into the desired final shape, wherein rapid cooling is simultaneously performed in the course of shaping, so that a martensitic or bainitic structure is obtained while the sheet remains in the shaping device. Boron-alloy carbon steel or carbon manganese steel, for example, are used as the starting materials. In accordance with this publication, shaping preferably is performed by pressure, but other methods can also be employed. Shaping and cooling should preferably be performed in such a way and so rapidly, that a fine-grained martensitic or bainitic structure is obtained.

A method for producing a hardened profiled sheet metal part from a plate, which is heat-formed and hardened in a pressure tool into a profiled sheet metal part, is known from EP 1 253 208 A1. In the course of this, reference points, or collars, projecting out of the plane of the plate, are created on the profiled sheet metal part, which are used for determining the position of the profiled sheet metal part during the subsequent processing operations. It is intended to form the collars out of non-perforated areas of the plate in the course of the shaping process, wherein the reference points are created in the form of stampings at the edge or of passages or collars in the profiled sheet metal part. Hot-forming and hardening in the pressing tool are said to generally have advantages because of the efficient working through a combination of the shaping and hardening and tempering processes in one tool. By means of clamping of the profiled sheet metal part in the tool and on account of the thermal stress, however, an exactly predictable warping of the part cannot arise. This can have disadvantageous effects on subsequent processing operations, so therefore the reference points on the profiled sheet metal part are created.

A method for producing sheet steel products is known from DE 197 23 655 A1, wherein a sheet steel product is shaped in a pair of cooled tools while it is hot and is hardened into a martensitic structure while still in the tool, so that the tools are used for fixation during hardening. In the areas in which processing is to take place following hardening, the steel should be maintained in the soft steel range, wherein inserts in the tools are used for preventing rapid cooling, and therefore a martensitic structure, in these areas. The same effect is said to be possible to obtain by means of cutouts in the tools, so that a gap appears between the sheet steel and the tools. The disadvantage with this method is that because of considerable warping which can occur in the course of this, the subject method is unsuitable for pressure-hardening structural parts of more complex structures.

A method for producing locally reinforced shaped sheet metal parts is known from DE 100 49 660 A1, wherein the basic sheet metal of the structural part is connected in defined positions in the flat state with the reinforcement sheet metal and this so-called patched sheet metal compound is subsequently shaped together. For improving the production method in respect to the product of the method and the results, as well as to unburden it in respect to the means for executing the method, the patched compound sheet metal is heated to at least 800 to 850° prior to shaping, is quickly inserted, is rapidly shaped in the heated state and, while the shaped state is mechanically maintained, is subsequently definitely cooled by contact with the shaping tool, which is forcibly cooled from the inside. The substantially important temperature range between 800 and 500° C., in particular, is intended to be passed at a defined cooling speed. It is stated that the step of combining the reinforcing sheet metal and the basic sheet metal is easily integratable, wherein the parts are hard-soldered to each other, by means of which it is simultaneously possible to achieve an effective corrosion protection at the contact zone. The disadvantage with this method is that the tools are very elaborate, in particular because of the definite interior cooling.

A method and a device for pressing and hardening a steel part are known from DE 2 003 306. The goal is to press sheet steel pieces into shapes and to harden them, wherein it is intended to avoid the disadvantages of known methods, in particular that parts made of sheet steel are produced in sequential separate steps by mold-pressing and hardening. In particular, it is intended to avoid that the hardened or quenched products show warping of the desired shape, so that additional work steps are required. To attain this it is provided to place a piece of steel, after it has been heated to a temperature causing its austenitic state, between a pair of shaping elements which work together, after which the piece is pressed and simultaneously heat is rapidly transferred from the piece into the shaping elements. During the entire process the pieces are maintained at a cooling temperature, so that a quenching action under shaping pressure is exerted on the piece.

It is known from DE 101 20 063 C2 to conduct profiled metal structural elements for motor vehicles made of a starting material provided in tape form to a roller profiling unit and to shape them into roller-profiled parts wherein, following the exit from the roller profiling unit, partial areas of the roller-profiled parts are inductively heated to a temperature required for hardening and are subsequently quenched in a cooling unit. Following this it is intended for the roller-profiled parts to be cut to size into profiled structural parts.

A method for producing a part with very great mechanical properties is known from U.S. Pat. No. 6,564,604 B2, wherein the part is to be produced by punching a strip made of rolled sheet steel, and wherein a hot-rolled and coated material in particular is coated with a metal or a metal-alloy, which is intended to protect the surface of the steel, wherein the sheet steel is cut and a sheet steel preform is obtained, the sheet steel preform is cold- or hot-shaped and is either cooled and hardened after hot-shaping or, after cold-shaping is heated and thereafter cooled. An intermetallic alloy is to be applied to the surface prior to or following shaping and offers protection against corrosion and steel decarbonization, wherein this intermetallic mixture is also said to have a lubricating function. Subsequently, excess material is removed from the shaped part. The coating is said to be based in general on zinc or zinc and aluminum. It is possible here to use steel which is electrolytically zinc-coated on both sides, wherein austenizing should take place at 950° C. This electrolytically zinc-coated layer is completely converted into an iron-zinc alloy in the course of austenization. It is stated that during shaping and while being held for cooling, the coating does not hinder the outflow of heat through the tool, and even improves the outflow of heat. Furthermore, this publication proposes as an alternative to an electrolytically zinc-coated tape to employ a coating of 45% to 50% zinc and the remainder aluminum. The disadvantage of the mentioned method in both its embodiments is that a cathodic corrosion protection practically no longer exists. Moreover, such a layer is so brittle that cracks occur in the course of shaping. A coating with a mixture of 45 to 50% zinc and 55 to 45% aluminum also does not provide a corrosion protection worth mentioning. Although it is claimed in this publication that the use of zinc or zinc alloys as a coating would provide a galvanic protection even for the edges, it is not possible in actuality to achieve this. In actuality it is not even possible to provide a sufficient galvanic protection for the surface by means of the described coatings.

A manufacturing method for a structural part from a rolled steel tape, and in particular a hot-rolled steel tape, is known from EP 1 013 785 A1. The goal is said to be the possibility of offering rolled sheet steel of 0.2 to 2.0 mm thickness which, inter alia, is coated after hot-rolling and which is subjected to shaping, cold or hot, following a thermal treatment, in which the rise of the temperature prior to, during and after hot-shaping or the thermal treatment is intended to be assured without a decarbonation of the steel and without oxidation of the surfaces of the above mentioned sheets. For this purpose, the sheet is to be provided with a metal or a metal alloy, which assures the protection of the surface of the sheet, thereafter the sheet is to be subjected to a temperature increase for shaping, subsequently a shaping of the sheet is to be performed, and finally the part is to be cooled. In particular, the sheet is to be pressed in the hot state and the part created by deep-drawing is to be cooled in order to be hardened, and this at a speed greater than the critical hardening speed. A steel alloy which is said to be suitable is furthermore disclosed, wherein this sheet steel is to be austenized at 950° C. prior to being shaped in the tool and hardened. The applied coating is said to consist in particular of aluminum or an aluminum alloy, wherein not only an oxidation and decarbonizing protection, but also a lubrication effect is said to result from this. Although in contrast to other known methods it is possible with this method to avoid that during the following heating process the sheet metal part oxidizes after being heated to the austenizing temperature, basically cold-shaping as represented in this publication is not possible with hot-dip galvanized sheets, since the hot-dip aluminized layer has too low a ductility for larger deformations. The creating of more complex shapes by deep-drawing processes in particular is not possible with such sheet metals in the cold state. Hot-shaping, i.e. shaping and hardening in a single tool, is possible with such a coating, but afterward the structural part does not have any cathodic protection. Moreover, such a structural part must be worked mechanically or by means of a laser after hardening, so that the already described disadvantage occurs that subsequent processing steps are very expensive because of the hardness of the material. Further than that, there is the disadvantage that all areas of the shaped part which were cut by means of a laser or mechanically, no longer have any corrosion protection.

For producing a shaped metallic structural element, in particular a structural body element made as a semi-finished product from unhardened, heat-formable sheet steel, it is known from DE 102 54 695 B3 to initially shape the semi-finished product into a structural element blank by means of a cold-forming process, in particular deep-drawing. Thereafter the edges of the structural element blank are to be trimmed to an edge contour approximately corresponding to the structural element to be produced. Finally, the dressed structural element blank is heated and pressure-hardened in a hot-forming tool. The structural element created in the course of this already has the desired edge contour after hot-forming, so that final trimming of the edge of the structural part is omitted. In this way it is intended to considerably shorten the cycling time when producing hardened structural parts made of sheet steel. The steel used should be an air-hardening steel which, if required, is heated in a protective gas atmosphere in order to prevent scaling during heating. Otherwise a scale layer is removed from the shaped structural part after the latter has been hot-formed. It is mentioned in this publication that in the course of the cold-forming process the structural element blank is formed closely to its final contours, wherein "closely to the final contours" is to be understood to mean that those portions of the geometric shape of the finished structural part which accompany a macroscopic flow of material have been completely formed in the structural element blank at the end of the cold-forming process. Thus, at the end of the cold-forming process only slight matching of the shape, which requires a minimal local flow of material, should be necessary for producing the three-dimensional shape of the structural part. The disadvantage of this method lies in that a final shaping step of the entire contour in the hot state still takes place, wherein for preventing scaling either the known procedure, wherein annealing is performed in a protective gas atmosphere, must be performed, or the parts must be descaled. Both processes must be followed by a subsequent coating of the piece against corrosion.

In summation it can be stated that it is disadvantageous in connection with all the above mentioned methods that it is necessary to further process the produced parts after shaping and hardening, which is expensive and elaborate. Moreover, the structural parts either have no, or only insufficient protection against corrosion.

OBJECT AND SUMMARY OF THE INVENTION

It is an object of the invention to create a method for producing hardened structural parts made of sheet steel which is simple and can be rapidly performed and which makes it possible to produce hardened structural parts made of sheet steel, in particular thin sheet steel, with cathodic corrosion protection and to exact dimensions and without requiring finishing, such as descaling and sandblasting.

It is a further object to produce a hardened structural part made of sheet steel, which has corrosion protection, is dimensionally stable and dimensionally accurate and involves reduced production costs.

In accordance with the invention, the shaping of the structural parts, as well as the trimming and perforation of the structural parts takes place substantially in the unhardened state. The relatively good shaping capability of the special material used in the unhardened state permits the realization of more complex structural part geometries and replaces the expensive later trimming in the hardened state by substantially more cost-effective mechanical cutting operations prior to the hardening process.

The unavoidable dimensional changes because of heating the structural part are already being taken into consideration in the shaping of the cold sheet metal, so that the structural part is produced approximately 0.5 to 2% smaller than its final dimensions. At least the expected heat expansion during shaping is taken into consideration.

In connection with cold working of the structural part, i.e. shaping, trimming and perforating, it is sufficient to produce the areas of the finished hardened structural part of high complexity and shaping depth, and if required the areas with close tolerances of the structural part, such as in particular the cut edges, the shaped edges, the shaped surfaces and possibly the perforation pattern, such as in particular the perforation holes with the desired final tolerances, and in particular the trimming and positional tolerances, wherein here the heat expansion of the structural part because of heat is taken into consideration or compensated.

This means that following cold shaping the structural part is approximately 0.5 to 2% smaller than the target final dimensions of the finished hardened structural part. Smaller here means that, following cold shaping, the structural part is finish-shaped in all three spatial axes, i.e. three-dimensionally. In this way the heat expansion is taken into consideration identically in connection with all three spatial axes. It is not possible in the prior art to take the heat expansion into consideration in connection with all spatial axes, for example an expansion could only be taken into consideration in the Z-direction because of the incomplete closing of the mold causing an incomplete shaping here. In accordance with the invention, preferably the three-dimensional geometric shape or contour of the tool is made smaller in all three dimensions.

Moreover, in accordance with the invention, hot-dip galvanized sheet steel, and in particular hot-dip galvanized sheet steel with a corrosion-protection coating of a special composition, is used.

Up to now it had been assumed in the technological field that zinc-coated sheet steel is noted as suitable for such processes in which a heating step takes place prior to or following shaping. For one, this is caused by the zinc layers becoming strongly oxidized above the furnace temperatures of approximately 900 to 950° which had been customarily used, or are volatile under protective gas (oxygen-free atmosphere).

The corrosion protection in accordance with the invention for sheet steel, which is initially subjected to heat treatment and thereafter shaped and hardened in the process, is a cathodic corrosion protection which is substantially based on zinc. In accordance with the invention, 0.1% up to 15% of one or several elements with affinity to oxygen, such as magnesium, silicon, titanium, calcium and aluminum are added to the zinc constituting the coating. It was possible to determine that such small amounts of elements with affinity to oxygen, such as magnesium, silicon, titanium, calcium and aluminum, result in a surprising effect in this special application.

In accordance with the invention, at least Mn, Al, Ti, Si, Ca are possible elements with affinity to oxygen. In the following, whenever aluminum is mentioned, it is intended to also stand for all of the other elements mentioned here.

It has been surprisingly shown that, in spite of the small amount of an element with affinity to oxygen, such as aluminum in particular, a protective layer clearly forms on the surface during heating, which substantially consists of $Al_2O_3$, or an oxide of the element with affinity to oxygen (MgO, CaO, TiO, $SiO_2$), which is very effective and self-repairing. This very thin oxide layer protects the underlying Zn-containing corrosion-protection layer against oxidation, even at very high temperatures. This means that in the course of the special continued processing of the zinc-coated sheet during the pressure-hardening method, an approximately two-layered corrosion-protection layer is formed, which consists of a cathodically highly effective layer with a high proportion of zinc, and is protected against oxidation and evaporation by an oxidation-protection layer consisting of an oxide ($Al_2O_3$, MgO, CaO, TiO, $SiO_2$). Thus, the result is a cathodic corrosion-protection layer of an outstanding chemical durability. This means that the heat treatment must take place in an oxidizing atmosphere. Although it is possible to prevent oxidation by means of a protective gas (oxygen-free atmosphere), the zinc would evaporate because of the high vapor pressure.

It has furthermore been shown that the corrosion-protection layer in accordance with the invention also has so great a mechanical stability in connection with the pressure-hardening method that a shaping step following the austenization of the sheets does not destroy this layer. Even if microscopic cracks occur, the cathodic protection effect is at least clearly greater than the protection effect of the known corrosion-protection layers for the pressure-hardening method.

To provide a sheet with the corrosion protection in accordance with the invention, in a first step a zinc alloy with an aluminum content in weight-% of greater than 0.1, but less than 15%, in particular less than 10%, and fuirther preferred of less than 5%, can be applied to sheet steel, in particular alloyed sheet steel, whereupon in a second step portions are formed out of the coated sheet, in particular cut out or punched out, and are heated with the admission of atmospheric oxygen to a temperature above the austenization temperature of the sheet alloy and thereafter are cooled at an increased speed. Shaping of the parts (the plate) cut out of the sheet can take place prior to or following heating of the sheet to the austenization temperature.

It is assumed that in the first step of the method, namely in the course of coating the sheet on the sheet surface, or in the proximate area of the layer, a thin barrier phase of $Fe_2Al_{5-x}Zn_x$ in particular is formed, which prevents Fe—Zn diffusion in the course of a liquid metal coating process taking place in particular at a temperature up to 690° C. Thus, in the first method step a sheet with a zinc-metal coating with the addition of aluminum is created, which has an extremely thin barrier phase only toward the sheet surface, as in the proximal area of the coating, which is effective against a rapid growth of a zinc-iron connection phase. It is furthermore conceivable that the presence of aluminum alone lowers the iron-zinc diffusion tendency in the area of the boundary layer.

If now in the second step heating of the sheet provided with a metallic zinc-aluminum layer to the austenization temperature of the sheet material takes place with the admission of atmospheric oxygen, initially the metal layer on the sheet is liquefied. The aluminum, which has an affinity to oxygen, is reacted out of the zinc on the distal surface with atmospheric oxygen while forming a solid oxide, or an oxide of aluminum, because of which a decrease in the aluminum metal concentration is created in this direction, which causes a continuous diffusion of aluminum towards depletion, i.e. in the direction toward the distal area. This enrichment with oxide of aluminum at the area of the layer exposed to air now acts as an oxidation protection for the layer metal and as an evaporation barrier for the zinc.

Moreover, during heating, the aluminum is drawn out of the proximal barrier phase by continuous diffusion in the direction toward the distal area and is available there for the formation of a surface $Al_2O_3$ layer. In this way the formation of a sheet coating is achieved which leaves behind a cathodically highly effective layer with a large proportion of zinc.

For example, a zinc alloy with a proportion of aluminum in weight-% of greater than 0.2, but less than 4, preferably in an amount of 0.26, but less than 2.5 weigh-%, is well suited.

If in an advantageous manner the application of the zinc alloy layer to the sheet surface takes place in the first step in the course of passing through a liquid metal bath at a temperature greater than 425° C., but lower than 690° C., in particular at 440° C. to 495° C., with subsequent cooling of the coated sheet, it is not only effectively possible to form a proximal barrier phase, or to observe a good diffusion prevention in the area of the barrier layer, but an improvement of the heat deformation properties of the sheet material also takes place along with this.

An advantageous embodiment of the invention is provided by a method in which a hot- or cold-rolled steel tape of a thickness greater than 0.15 mm, for example, is used and within a concentration range of at least one of the alloy elements within the limits, in weight-%, of

| | | |
|---|---|---|
| Carbon | up to 0.4 | preferably 0.15 to 0.3 |
| Silicon | up to 1.9 | preferably 0.11 to 1.5 |
| Manganese | up to 3.0 | preferably 0.8 to 2.5 |
| Chromium | up to 1.5 | preferably 0.1 to 0.9 |
| Molybdenum | up to 0.9 | preferably 0.1 to 0.5 |
| Nickel | up to 0.9 | |
| Titanium | up to 0.2 | preferably 0.02 to 0.1 |
| Vanadium | up to 0.2 | |
| Tungsten | up to 0.2 | |
| Aluminum | up to 0.2 | preferably 0.02 to 0.07 |
| Boron | up to 0.01 | preferably 0.0005 to 0.005 |
| Sulfur | 0.01 max. | preferably 0.008 max. |
| Phosphorus | 0.025 max | preferably 0.01 max. |

the rest iron and impurities.

It was possible to determine that the surface structure of the cathodic corrosion protection in accordance with the invention is particularly advantageous in regard to the adhesiveness of paint and lacquer.

The adhesion of the coating on the object made of sheet steel can be further improved if the surface layer has a zinc-rich intermetallic zinc-iron-aluminum phase and an iron-rich iron-zinc-aluminum phase, wherein the iron-rich phase has a ratio of zinc to iron of at most 0.95 ($Zn/Fe \leqq 0.95$), preferably of 0.20 to 0.80 ($Zn/Fe=0.20$ to 0.80), and the zinc-rich phase a ratio of zinc to iron of at least 2.0 ($Zn/Fe \geqq 2.0$), preferably of 2.3 to 19.0 ($Zn/Fe=2.3$ to 19.0).

In the method in accordance with the invention, such a zinc layer is apparently not substantially affected during cold shaping. Instead, in accordance with the invention zinc material is transported in an advantageous manner by the tool from the zinc layer onto the cut edge in the course of trimming and perforating the cold plate and is smeared along the cut edge.

Moreover, coating with zinc has the advantage that the structural part loses less heat following heating and transfer into a mold-hardening tool, so that the structural part need not be heated too high. Reduced thermal expansion occurs because of this, so that a production accurate as to tolerances is simplified, because the totality of the expansion is less.

Furthermore, at the lower temperature the structural part has increased stability, which makes possible improved handling and more rapid insertion into the mold.

The invention will be explained by way of example by means of the drawings.

BRIEF DESCRIPTION OF THE DRAWINGS

The single drawing FIGURE shows the course of the method in accordance with the invention.

DETAILED DESCRIPTION OF THE PREFERRED EMBODIMENT

For executing the method, the unhardened, zinc-coated special thin sheet is first cut into plates.

The processed plates can be rectangular, trapezoidal or shaped plates. Any of the known cutting processes can be employed for cutting the plates. Preferably those cutting processes are employed which do not introduce heat into the sheet metal during cutting.

Subsequently, shaped parts are produced from the trimmed plates by means of cold-forming tools. This production of shaped parts includes all methods and/or processes capable of producing these shaped parts. For example, the following methods and/or processes are suitable:

Sequential compound tools,
Individual tools in linkage,
Stepped sequential tools,
Hydraulic press line,
Mechanical press line,
Explosive shaping, electromagnetic shaping, tube hydraulic shaping, plate hydraulic shaping,
and all cold shaping processes.

After shaping, and in particular deep-drawing, the final trim is performed in the mentioned customary tools.

In accordance with the invention, the shaped part, which had been shaped in its cold state, was produced smaller by 0.5 to 2% than the nominal geometric shape of the finished structural part, so that heat expansion in the course of heating is compensated.

The shaped parts produced by means of the mentioned process should be cold-formed, wherein their dimensions lie within the tolerance range for the finished part required by the customer. If in the course of the previously mentioned cold-forming process large tolerances occur, these can be partially slightly corrected later in the course of the mold-hardening process, which will still be addressed. However, the tolerance correction in the mold-hardening process is preferably performed only for deviations in shape. Such shape deviations can therefore be corrected in the manner of a heat calibration. But if possible, the correction process should be limited to a bending process only, because cut edges which are a function of the amount of material (in relation to the cut edge) should not and cannot be affected later, i.e. if the geometric shape of the cut edges in the parts is not correct, no correction can be performed in the mold-hardening tool. In summation it can therefore be stated that the tolerance range in respect to the cut edges corresponds to the tolerance range during the cold-shaping and mold-hardening process.

Preferably no marked folds should exist in the shaped part, since in that case the uniformity of the pressure pattern and a uniform mold-hardening process cannot be assured.

After the structural part has been completely shaped, the shaped and trimmed part is heated to an annealing temperature of more than 780° C., in particular 800° C. to 950° C., and is maintained a few seconds or up to a few minutes at this temperature, but at least long enough so that desired austenization has taken place.

Following the annealing process, the structural part is subjected to the mold-hardening step in accordance with the invention. For the mold-hardening step the structural part is inserted into a tool inside of a press, wherein this mold-hardening tool preferably corresponds to the final geometric shape of the finished structural part, i.e. the size of the cold-produced structural part, including its heat expansion.

For this purpose, the mold-hardening tool has a geometric shape, or contour, which substantially corresponds to the geometric shape, or contour, of the cold-shaping tool, but is 0.5 to 2% larger (in regard to all three spatial axes). In connection with mold-hardening a full-surface positive contact between the mold-hardening tool and the workpiece, or structural part, to be hardened is sought directly upon closing of the tool.

The shaped part is inserted at a temperature of approximately 740° C. to 910° C., preferably 780° C. to 840° C., into the mold-hardening tool wherein, as already explained, the previously performed cold-shaping process had taken the heat expansion of the part at this insertion temperature range into consideration.

Because of the zinc-coating of the structural part in accordance with the invention it is still possible to achieve an insertion temperature between 780° C. to 840° C. even if the annealing temperature of the cold-shaped structural part lies between 800° C. and 850° C. since, in contrast to uncoated sheets, the special zinc layer in accordance with the invention reduces a rapid cool-down. This has the advantage that the parts need to be less strongly heated and heating to a temperature above 900° C. in particular can be avoided. This results in turn in the interaction with the zinc coating, since at slightly lower temperatures the zinc coating is less negatively affected.

Heating and mold-hardening will be explained by way of example in what follows.

For performing the mold-hardening process, a part in particular is initially removed by a robot from a conveyor belt and inserted into a marking station, so that each part can be marked in a reproducible manner prior to mold-hardening. Subsequently, the robot places the part on an intermediate support, wherein the intermediate support runs through a furnace on a conveyor belt and the part is heated.

For example, a continuous furnace with heating by convection is used for heating. However, any other heating units, or furnaces, can be employed, in particular also furnaces in which the shaped parts are heated electro-magnetically or by means of microwaves. The shaped part moves through the furnace on the support, wherein the support has been provided so that during heating the corrosion-protection coating is not transferred to the rollers of the continuous furnace, or is rubbed off by the latter.

The parts are heated in the furnace to a temperature which lies above the austenizing temperature of the alloy used. Since, as already mentioned, the zinc coating is not particularly stable, the maximum temperature of the parts is kept as low as possible which, also as already mentioned, is made possible because the part later on is cooled slower because of the zinc coating.

Following the heating of the parts to a maximum temperature, for obtaining complete hardening and sufficient corrosion protection it is necessary, starting at a defined minimum temperature (>700° C.), to cool them at a minimum cooling speed of >20 K/s. This cooling speed is achieved in the course of subsequent mold-hardening.

To this end, also depending on the thickness, a robot takes the part out of the furnace at 780° C. to 950° C., in particular between 860° C. and 900° C., and places it into the mold-hardening tool. In the course of manipulation, the part loses approximately 10° C. to 80° C., in particular 40° C., wherein the robot is particularly designed for the insertion in such a way that it accurately inserts the part at high speed into the mold-hardening tool. The shaped part is placed by the robot on a parts-lifting device, and thereafter the press is rapidly lowered, wherein the parts-lifting device is displaced and the part is fixed in place. To this end it is assured that the part is cleanly positioned and conducted until the tool is closed. At the time at which the press, and therefore the mold-hardening tool, is closed, the part still has a temperature of at least 780° C. The surface of the tool has a temperature of less than 50° C., so that the part is rapidly cooled down to between 80° C. and 200° C. The longer the part is kept in the tool, the greater is the dimensional accuracy.

In the course of this the tool is stressed by thermal shock, wherein the method of the invention makes it possible, in particular if no shaping steps are performed during the mold-hardening step, to design the tool in respect to its basic material to a high thermal shock resistance. With conventional methods the tools must have a high abrasion resistance in addition, however, in the present case this is of no particular importance and in this respect also makes the tool less expensive.

When inserting the shaped part, care must be taken that the completely trimmed and perforated part is inserted into the mold-hardening tool in a correctly fitting manner, wherein no excess material and no protruding material should be present. Angles can be corrected by simple bending, but excess material cannot be eliminated. For this reason it is necessary that the cut edges on the cold-shaped part be cut with dimensional accuracy in relation to the mold edges. The trimmed edges should be fixed in place during mold-hardening in order to avoid displacement of the trimmed edges.

Thereafter a robot removes the parts from the press and deposits them on a stand, where they continue to cool. If desired, cooling can be speeded up by additionally blowing air on them.

By means of the mold-hardening in accordance with the invention without shaping steps worth mentioning and with a substantially full-face positive connection between tool and workpiece, it is assured that all areas of the workpiece are defined and are uniformly cooled from all sides at the same time. With customary shaping processes, reproducible defined cooling only takes place when the shaping process has progressed sufficiently so that the material rests against both halves of the mold. In the present case, however, the material preferably rests immediately on all sides against the mold halves in a positively connected manner.

It is moreover advantageous that corrosion-protection coatings existing on the sheet surface, and in particular layers applied by means of hot-dip galvanizing, are not damaged.

It is furthermore advantageous that, in contrast to customary processing methods, the expensive final trimming after hardening is no longer required. A considerable cost advantage ensues from this. Since deformation, or shaping, substantially takes place in the cold state prior to hardening, the complexity of the structural part is substantially only determined by the deformation properties of the cold, unhardened material. Because of this it is possible to produce considerably more complex hardened structural parts of higher quality than up to now by means of the method of the invention.

An additional advantage is the reduced stress on the mold-hardening tool because of the completely existing final geometric shape in the cold state. It is possible by means of this to obtain a substantially longer tool service life, as well as dimensional accuracy, which means a cost reduction in turn.

It is possible to save energy because the parts need not be annealed at such high temperatures.

Based on the definite cooling of the workpieces in all their parts without an additional shaping process, which would affect the cooling negatively, the number of components which are not within the requirements can be clearly reduced, so that the manufacturing costs can again be lowered.

In connection with a further advantageous embodiment of the invention, mold-hardening is performed in such a way that a contact of the workpiece with the mold halves, or a positive connection between tool and workpiece, takes place only in the areas with close tolerances, such as the cut and shaped edges, the shaped surfaces and possibly in the areas of the perforation pattern.

In this connection the positive connection in these areas is caused in that these areas are so dependably held and clamped that areas of less close tolerances can undergo hot-shaping in the tool, without those areas which already have areas of close tolerance which are accurate as to position and dimensions, are not negatively affected and in particular warped.

With this advantageous embodiment, heat expansion which the structural part still possesses when being placed into the molding tool, is of course also taken into consideration in the already described manner.

However, in connection with this advantageous embodiment it is further possible to cool the areas with less close tolerance more slowly, either by not placing them against one or both molding tool halves and to achieve different degrees of hardness because of slower cooling, or to achieve a desired heat-shaping in these areas without the areas of closer tolerance being affected. For example, this can take place by additional dies in the molding tool halves. As already explained, it is also important in connection with this preferred embodiment that the areas of close tolerances remain unaffected in regard to shaping during mold-hardening.

What is claimed is:

1. A method for producing hardened structural parts from sheet steel, wherein the hardened structural parts have cathodic corrosion protection, comprising:

shaping at least one shaped part made of sheet steel provided with a cathodic corrosion protection coating, wherein the cathodic corrosion protection coating is applied using a hot-dip galvanizing, wherein the coating is a mixture comprising zinc, and the mixture contains at least one element with affinity to oxygen in a total amount of 0.1 weight-% to 15 weight-% in relation to the entire coating, and wherein in the course of heating the sheet steel to the temperature required for hardening, a skin of an oxide of the at least one element with affinity to oxygen is formed on a surface of the sheet steel thus imparting cathodic corrosion protection;

performing a final trim of the shaped part, punching, and/or the creation of a perforation pattern, prior to, during or after shaping of the shaped part;

heating the shaped part, at least over partial areas, under the admission of atmospheric oxygen to a temperature which permits austenizing of the steel material subsequent to performing the final trim, punching, and/or the creation of a perforation pattern on the shaped part; and thereafter transferring the structural part to a mold-hardening tool and performing mold-hardening in the mold-hardening tool, wherein the structural part is cooled by the contact with and pressing by the mold-hardening tool and is hardened thereby;

wherein the shaping and trimming, as well as punching and arrangement of a perforated pattern on the structural part, are performed in such a way that the shaped part is embodied to be 0.5% to 2.0% smaller than the finished structural part.

2. The method in accordance with claim 1, wherein magnesium and/or silicon and/or titanium and/or calcium and/or aluminum are employed as the elements with affinity to oxygen.

3. The method in accordance with claim 1, wherein 0.2 weight-% to 5 weight-% of the elements with affinity to oxygen are used.

4. The method in accordance with claim 1, wherein 0.26 weight-% to 2.5 weight-% of the elements with affinity to oxygen are used.

5. The method in accordance with claim 1, wherein aluminum is substantially employed as the element with affinity to oxygen.

6. The method in accordance with claim 1, wherein the coating mixture is selected in such a way that, in the course of heating, the coating forms an oxide skin of oxides of the element(s) with affinity to oxygen and the coating forms at least two phases, wherein a zinc-rich and an iron-rich phase are formed.

7. The method in accordance with claim 6, wherein the iron-rich phase is formed at a ratio of zinc to iron of 0.20 to 0.80 (Zn/Fe=0.20 to 0.80), and the zinc-rich phase is formed at a ratio of zinc to iron of 2.3 to 19.0 (Zn/Fe=2.3 to 19.0).

8. The method in accordance with claim 6, wherein the iron-rich phase has a ratio of zinc to iron of approximately 30:70, and the zinc-rich phase has a ratio of zinc to iron of approximately 80:20.

9. The method in accordance with claim 1, wherein the coating contains individual areas with zinc proportions >90% zinc.

10. The method in accordance with claim 1, wherein the coating is designed in such a way that, at an initial thickness of 15 μm, the coating has a cathodic protection effect of at least 4 $J/cm^2$ after the hardening process.

11. The method in accordance with claim 1, wherein the coating with the mixture of zinc and the elements with affinity to oxygen takes place in the course of a passage through a liquid metal bath at a temperature of 425° C. to 690° C. with subsequent cooling of the coated sheet.

12. The method in accordance with claim 1, wherein the coating with the mixture of zinc and the elements with affinity to oxygen takes place in the course of a passage through a liquid metal bath at a temperature of 440° C. to 495° C. with subsequent cooling of the coated sheet.

13. The method in accordance with claim 1, comprising using a layer having a constant thickness over the structural part as the cathodic corrosion-protection coating.

14. The method in accordance with claim 1, wherein an amount of time above the austenizing temperature is less than or equal to 10 minutes.

15. The method in accordance with claim 1, characterized in that a holding temperature in the heating phase is maximally 780 to 950° C.

16. The method in accordance with claim 1, wherein in the course of mold-hardening the areas of close tolerance of the shaped structural part, in particular the cut edges, the shaped edge and the perforation pattern, are clamped free of warping by the molding tool halves, wherein shaped part areas located outside the areas of close tolerance can be subjected to a further shaping step in the hot state.

17. The method in accordance with claim 1, comprising pressing and hardening the shaped part with the molding tool halves substantially simultaneously over the full surface and with the same force.

* * * * *